US011543100B2

(12) United States Patent
Yan et al.

(10) Patent No.: US 11,543,100 B2
(45) Date of Patent: Jan. 3, 2023

(54) LENS, LIGHT SOURCE MODULE, AND LAMP

(71) Applicants: SUZHOU OPPLE LIGHTING CO., LTD., Suzhou (CN); OPPLE LIGHTING CO., LTD., Shanghai (CN)

(72) Inventors: Lei Yan, Suzhou (CN); Zicai Ma, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/479,999

(22) Filed: Sep. 20, 2021

(65) Prior Publication Data

US 2022/0003386 A1 Jan. 6, 2022

Related U.S. Application Data

(63) Continuation of application No. PCT/CN2020/080055, filed on Mar. 18, 2020.

(51) Int. Cl.
*F21V 14/06* (2006.01)
*F21V 23/02* (2006.01)
(Continued)

(52) U.S. Cl.
CPC ..... *F21V 14/06* (2013.01); *F21V 17/005* (2013.01); *F21V 17/02* (2013.01); *F21V 23/02* (2013.01); *F21V 5/007* (2013.01)

(58) Field of Classification Search
CPC ..... F21V 14/06; F21V 17/02; F21V 17/002; F21V 17/005; F21V 17/04; F21V 17/06; F21V 17/162; F21V 5/007
See application file for complete search history.

(56) References Cited

U.S. PATENT DOCUMENTS 10,209,562 B2 * 2/2019 Nameda ..... G02F 1/133608
2012/0206917 A1 * 8/2012 Burkard ..... F21V 17/164 362/396
(Continued)

FOREIGN PATENT DOCUMENTS

CN 203162624 U 8/2013
CN 103511857 A * 1/2014
(Continued)

OTHER PUBLICATIONS

International Search Report of PCT Application No. PCT/CN2020/080055 dated Jun. 10, 2020 with English translation, (4p).

*Primary Examiner* — Erin Kryukova
(74) *Attorney, Agent, or Firm* — Arch & Lake LLP

(57) ABSTRACT

A lens, a light source module and a lighting device are provided. The lens includes a lens body and at least two positioning columns. An inner end of the positioning column is connected with the lens body, and an outer end is a free end. A direction from the outer end to the inner end of the positioning column is a first direction. The positioning column includes at least three positioning segments which are sequentially distributed in the first direction. A plane perpendicular to an axis of the positioning segment is a projection plane, and a projection of the positioning segment on the projection plane is a first projection, an area enclosed by an outer contour line of the first projection is a first area, and the first areas of at least three positioning segments are sequentially increased in the first direction.

13 Claims, 10 Drawing Sheets

(51) Int. Cl.

| | |
|---|---|
| ***F21V 17/02*** | (2006.01) |
| ***F21V 17/00*** | (2006.01) |
| ***F21V 5/00*** | (2018.01) |

(56) References Cited

U.S. PATENT DOCUMENTS

| | | | | |
|---|---|---|---|---|
| 2016/0363302 | A1* | 12/2016 | Madril | F21V 5/007 |
| 2021/0131647 | A1* | 5/2021 | Baumeister | F21V 17/164 |

FOREIGN PATENT DOCUMENTS

| | | | |
|---|---|---|---|
| CN | 103511910 | A | 1/2014 |
| CN | 207196256 | U | 4/2018 |
| CN | 108131573 | A | 6/2018 |
| CN | 209445299 | U | 9/2019 |

* cited by examiner

LENS, LIGHT SOURCE MODULE, AND LAMP

CROSS-REFERENCE TO RELATED APPLICATIONS

This application is a continuation application of International Application No. PCT/CN2020/080055, filed on Mar. 18, 2020, which is based upon and claims priority to Provisional Application No. 201920350348.1 filed on Mar. 19, 2019, the entire contents of which are incorporated herein by reference in their entireties.

TECHNICAL FIELD

The present application relates to the technical field of illumination, in particular to a lens, a light source module and a lighting device.

BACKGROUND

A lighting fixture includes a light source and a lens. After a traditional lighting fixture is assembled, a distance between the light source and the lens is fixed and cannot be adjusted, so that a beam angle of the lighting fixture cannot be adjusted according to different application scenarios. For example, under the application scenario having high requirements on light condensing, if the light condensing effect of the lighting fixture is poor, the emitted light is relatively divergent, then it's unable to adjust the beam angle of the lighting fixture, which results in inconvenience.

The existing technology also proposes a lighting fixture in which the lens is connected with a lamp housing, and a position of the lens is changeable by adjusting a position of the lamp housing, so as to achieve the purpose of adjusting the distance between the lens and the light source. However, such an adjustment structure is complex and the adjustment process is cumbersome.

SUMMARY

The technical problem to be solved by the present application lies in providing a lens, a light source module and a lighting device which allows for adjustable beam angle and convenient adjustment.

The technical solutions of the present application are as follows:

A lens, including a lens body and at least two positioning columns, wherein the lens body has a light incident surface and a light exiting surface, an inner end of the positioning column is connected to the light incident surface, an outer end of the positioning column is a free end, and a direction from the outer end to the inner end of the positioning column is a first direction;

the positioning column includes at least three positioning segments which are sequentially distributed in the first direction;

a plane perpendicular to an axis of the positioning segments is a projection plane, a projection of the positioning segment on the projection plane is a first projection, an area enclosed by an outer contour line of the first projection is a first area, and the first areas of at least three positioning segments are sequentially increased in the first direction.

A light source module, including a light source assembly and the lens described above, wherein the light source assembly includes a light source plate and a lamp body arranged on the light source plate, and at least two groups of positioning holes are also arranged on the light source plate; each group of positioning holes includes at least two positioning holes, and areas of the at least two positioning holes in each group of positioning holes are different; the positioning segment with the first area larger than an area of the positioning hole is a lower positioning segment; the positioning hole is sleeved and matched with the positioning segment, and a position of the positioning hole is limited by the lower positioning segment.

A lighting device, including a lamp housing, a power supply assembly and the light source module described above, wherein the power supply assembly is electrically connected with the light source assembly; the lamp housing is provided with a mounting cavity, and the light source module is mounted in the mounting cavity; the lamp housing is provided with a light outlet, and a distance between the lens and the light outlet is smaller than a distance between the light source assembly and the light outlet.

Figure 1:
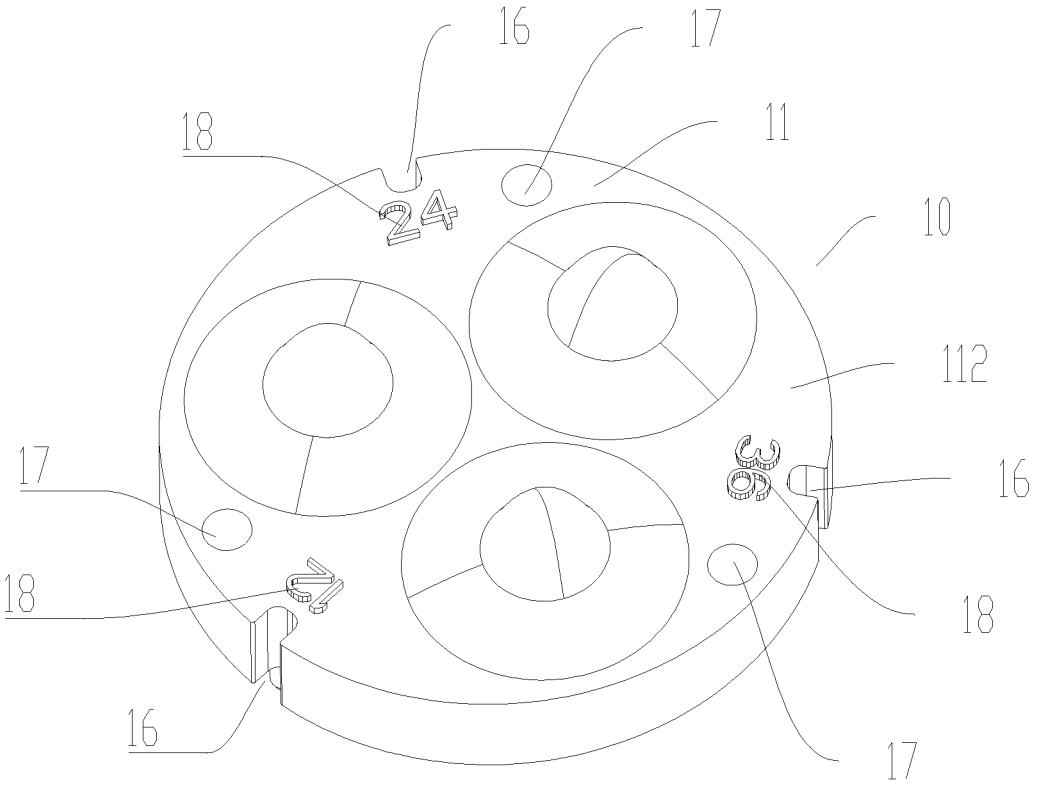
FIG. 1 is a perspective view of a light exiting surface of a lens according to one or more examples of the present application.

The names and labels of components in the drawing are as follows:

Lens 10, lens body 11, light incident surface 111, light guiding groove 1111, light exiting surface 112, light incident side 12, light emergent side 13, positioning column 14, first positioning segment 141', second positioning segment 141", third positioning segment 141'", fourth positioning segment 141"", first limiting surface 142' second limiting surface 142", third limiting surface 142'", groove 15, first positioning groove 16, first connecting hole 17, angle scale 18, light source assembly 20, light source plate 21, first positioning hole 211', second positioning hole 211", third positioning hole 211'", second connecting hole 212, lamp body 22, second positioning groove 23, lighting device 100, lamp housing 30, mounting cavity 31, light outlet 32, mounting end 33, positioning body 34, support ring 35, first avoidance groove 351', second avoidance groove 351", third avoidance groove 351'", avoidance hole 352, bottom cover 36, through hole 361, third connecting hole 37, light-transmitting mask 40, compression ring 50, connecting post 51, sealing ring 60, driving power supply 71, electric wire 72, base 80, strip hole 81, hinged shaft 82, connecting piece 91.

DETAILED DESCRIPTION

Examples of the present disclosure will be described in more detail below with reference to the accompanying drawings. Although examples of the present disclosure are shown in the accompanying drawings, it should be understood that the present disclosure may be implemented in various forms and should not be limited by the examples set forth herein. On the contrary, these examples are provided to enable a more thorough understanding of the present disclosure and to fully convey the scope of the present disclosure to those skilled in the art.

It should be noted that the features in the examples of the disclosure can be combined with each other without conflict. Sometimes, when it is necessary to adjust the irradiation angle of the lamp, it is generally to adjust the irradiation angle of the lamp manually or by using tools, which can't intelligently adjust the irradiation angle according to personal wishes and cannot meet the needs of users.

The present embodiment discloses a lens 10, which includes a lens body 11 and at least two positioning columns 14; the lens body 11 has a light incident surface 111 and a light existing surface 112; an inner end of the positioning column 14 is connected to the light incident surface 111, an outer end of the positioning column 14 is a free end, and the direction from the outer end to the inner end of the positioning column 14 is the first direction. The positioning column 14 includes at least three positioning segments which are sequentially distributed in the first direction. A plane perpendicular to an axis of the positioning segment is a projection plane, and a projection of the positioning segment on the projection plane is a first projection, an area enclosed by an outer contour line of the first projection is a first area, and the first areas of the at least three positioning segments are sequentially increased in the first direction.

The lens 10 of the present embodiment has the advantages that: because at least three positioning segments are sequentially distributed in the first direction and the first areas of the at least three positioning segments are sequentially increased in the first direction, two adjacent positioning segments form a limiting surface at an interface; and because the number of the positioning segments is at least three, the at least three positioning segments form at least two limiting surfaces. After the lens 10 in the present embodiment is connected with a light source assembly 20, the positioning columns 14 are sleeved and matched with positioning holes with different sizes in the light source assembly 20, and the positioning holes with different sizes are limited on different limiting surfaces, so that different distances are formed between the lens 10 and the light source assembly 20 in the present embodiment, thereby achieving the purpose of adjusting the beam angle and facilitating the adjustment of the beam angle.

Alternatively or additionally, the positioning column 14 is a stepped shaft, the positioning segment is a shaft segment, and areas of cross-sectional surfaces of at least three shaft segments are sequentially increased in the first direction. The shaft segment may be cylindrical, that is, a cross section of the cylindrical shaft segment is circular. The shaft segment can also be prismatic, that is, a cross section of the prismatic shaft segment is polygonal. Alternatively or additionally, the shaft segment of the present embodiment is cylindrical, which has the following advantages: firstly, it is convenient to fabricate the positioning column 14; secondly, after the lens 10 is connected with the light source assembly 20, the positioning column 14 and the positioning hole of the light source assembly 20 can be matched at any rotation angle, thus facilitating the connection between the lens 10 and the light source assembly 20 and also facilitating the adjustment of the distance between the lens 10 and the light source assembly 20 by rotating the lens 10.

Figure 2:
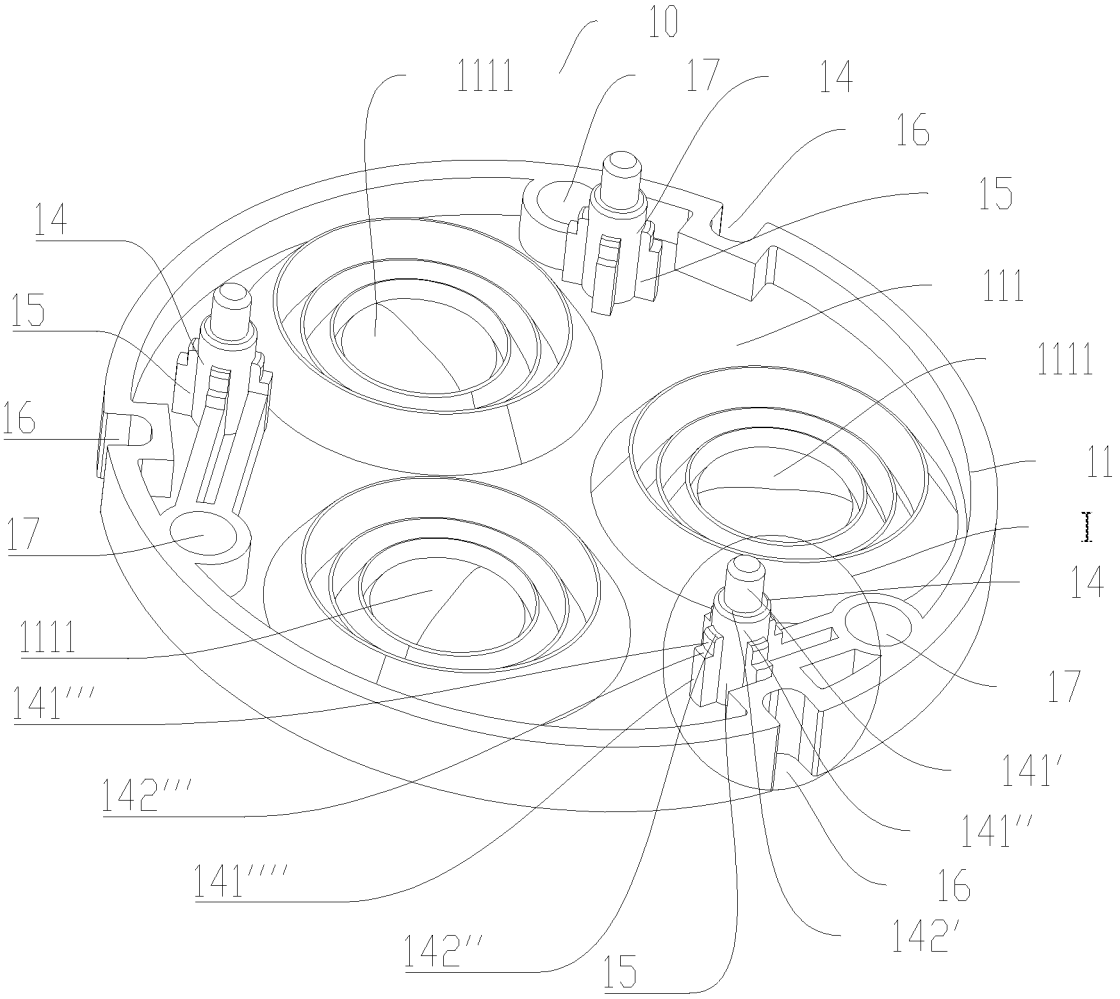
FIG. 2 is a perspective view of a light incident surface of the lens according to one or more examples of the present application.

As shown in FIG. 2, for example, a periphery surface of the stepped shaft is provided with at least one groove 15, and the groove 15 can be arranged along the first direction or inclined relative to the first direction. After the groove 15 is provided, the first areas of the at least three positioning segments are still increased sequentially in the first direction, and two adjacent positioning segments can still form a limiting surface at the interface. After the lens 10 is connected with the light source assembly 20, the positioning columns 14 are sleeved and matched with positioning holes with different sizes in the light source assembly 20, and the positioning holes with different sizes can still be limited on different limiting surfaces. The advantages of the grooves 15 are as follows: firstly, it can save materials; secondly, it can reduce the weight of the positioning column 14, thus reducing the weight of the whole lens 10.

In FIG. 2, the number of the grooves 15 is four, and the four grooves 15 are evenly distributed along a circumferential direction. In the present embodiment, the number of the grooves 15 may also be one, two, three, five and the like. In FIG. 2, there are four positioning segments, which are a first positioning segment 141', a second positioning segment 141", a third positioning segment 141'" and a fourth positioning segment 141"" in the first direction, sequentially, wherein the third positioning segment 141'" and the fourth positioning segment 141"" are provided with a groove 15, and the third positioning segment 141'" and the fourth positioning segment 141"" share a same groove 15. In the present embodiment, each positioning segment may be provided with the groove 15 independently, or at least two positioning segments may share the groove 15, or all positioning segments may share the groove 15. In the present embodiment, the number of the positioning segments can also be 3, 5, 6 and the like.

As shown in FIG. 2, preferably, the light incident surface 111 is provided with a light guiding groove 1111, and the light guiding groove 1111 is recessed towards the light exiting surface 112. The function of the light guiding groove 1111 is to improve the light emitting efficiency. In FIG. 2, the number of the light guiding grooves 1111 is three, and lines connecting centers of the three light guiding grooves 1111 can form an isosceles triangle. Alternatively or additionally, the lines connecting the centers of the three light guiding grooves 1111 form an equilateral triangle. The advantage of uniform distribution of the light guiding grooves 1111 is that, the lens 10 has a better light equalizing effect. In the present embodiment, the number of the light guiding grooves 1111 can also be 2, 4, 5 and the like. In the present embodiment, the light guiding structure on the lens body 11 can also be a spot-shaped light distribution part besides the light guiding groove 1111; there may be serval spot-shaped light distribution parts, and the several spot-shaped light distribution parts are distributed on the lens body 11. The light guiding structure on the lens body 11 of the present embodiment can also be an annular-shaped light distribution part, which can be integrally formed with the lens body 11.

As shown in FIG. 2, preferably, an external rim of the lens body 11 is provided with at least two first positioning grooves 16 which are distributed at intervals, and the number of the first positioning grooves 16 is one less than the number of the shaft segments. That is, the number of the first positioning grooves 16 in the present embodiment is the same as that of the limiting surfaces. Since the positioning holes with different sizes in the light source assembly 20 are arranged at different positions, the lens body 11 needs to be rotated to fit with the positioning holes with different sizes in the light source assembly 20, and the positioning holes with different sizes are limited on different limiting surfaces. After the lens body 11 rotates, in order to better fix the lens body 11 and the light source assembly 20, it is necessary to limit the lens body 11 and the light source assembly 20. An inner wall of the lamp housing 30 is provided with a positioning body 34, and the positioning body 34 is in limited fit with the first positioning groove 16. The number of the positioning body 34 is one, so the number of the first positioning grooves 16 needs to be the same as the number of the limiting surfaces. Every time when the lens body 11 rotates, it enables one first positioning groove 16 to be arranged opposite to the positioning body 34 on the inner wall of the lamp housing 30 and to be in limited fit with the positioning body 34.

As shown in FIG. 1, preferably, the light exiting surface 112 is provided with at least two angle scales 18, and the at least two angle scales 18 are arranged in one-to-one correspondence with the at least two first positioning grooves 16. The value of the angle scale 18 is the angle of the beam angle. The advantage of setting the angle scale 18 is that, it is convenient to adjust the distance between the lens 10 and the light source assembly 20, so as to adjust the angle of the beam angle. When the angle of the beam angle needs to be adjusted, the lens 10 is rotated so that the first positioning groove 16 corresponding to the target angle scale 18 is in limited fit with the positioning body 34 on the inner wall of the lamp housing 30. At this time, the beam angle is the target angle scale 18, which results it convenient to adjust the beam angle. Therefore, another advantage of the first positioning groove 16 of the present embodiment is that, the angle scale 18 can be combined with the positioning body 34 on the inner wall of the lamp housing 30, which is convenient for the operator to adjust the beam angle.

Figure 6:
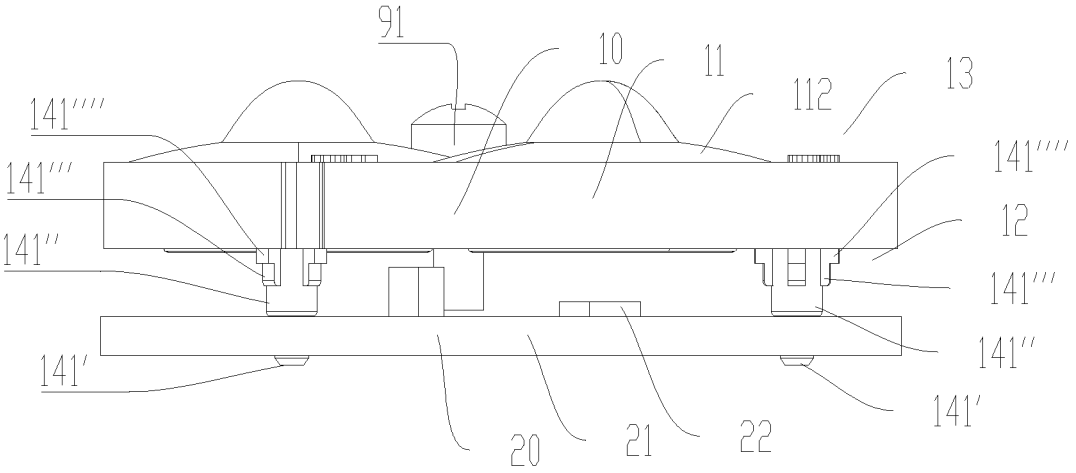
FIG. 6 is a side view of the light source module in one or more examples of the present application under a third beam angle.
Figure 7:
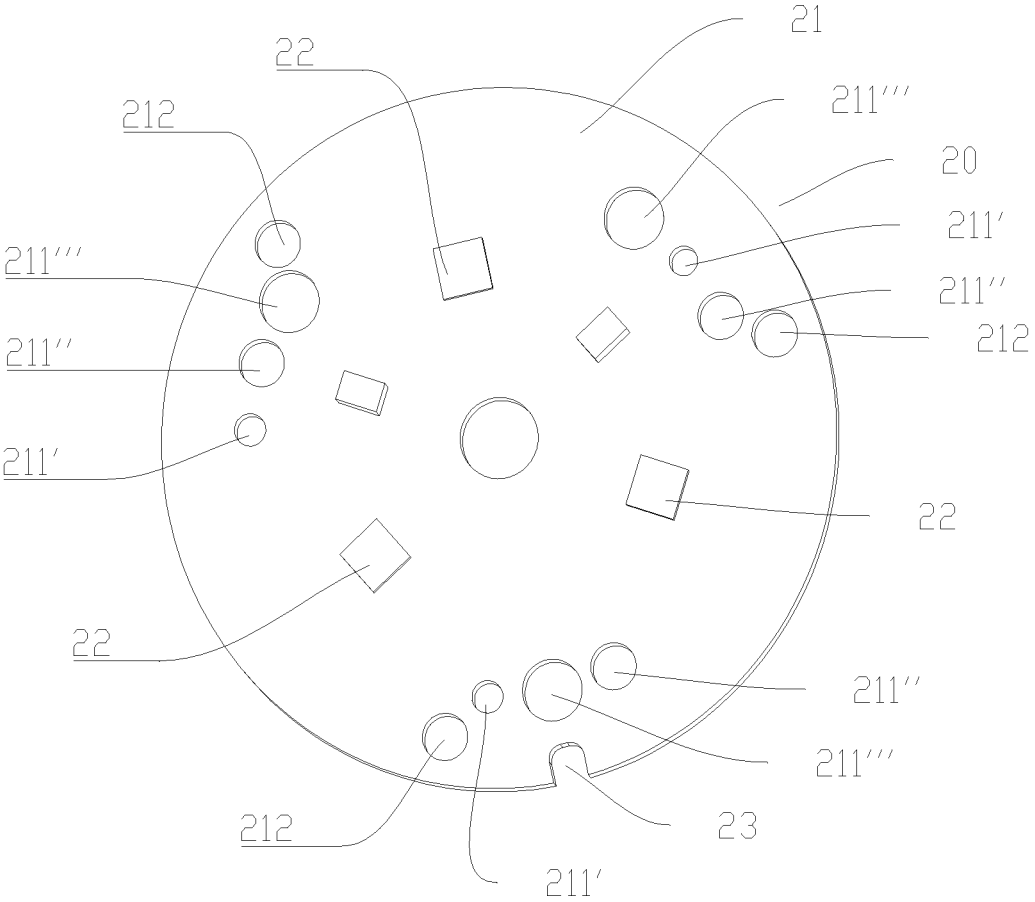
FIG. 7 is a structural diagram of a light source assembly in one or more examples of the present application.

The present embodiment discloses a light source module, which includes a light source assembly 20 and the lens 10 of the first embodiment. As shown in FIG. 7, the light source assembly 20 includes a light source plate 21 and a lamp body 22 arranged on the light source plate 21, and the light source plate 21 is also provided with at least two groups of positioning holes. Each group of positioning holes includes at least two positioning holes, and areas of the at least two positioning holes of each group of positioning holes are different. The positioning segment with the first area larger than an area of an orifices of the positioning hole is a lower positioning segment. The positioning hole is sleeved and matched with the positioning segment, and the positioning hole is limited by the lower positioning segment. As shown in FIG. 6, the light source plate 21 is located on the light incident side 12 of the lens 10.

The light source module of the present embodiment has the advantages that: because at least three positioning segments are sequentially distributed in the first direction and the first areas of the at least three positioning segments are sequentially increased in the first direction, two adjacent positioning segments form a limiting surface at an interface; and because the number of the positioning segments is at least three, the at least three positioning segments form at least two limiting surfaces. After the lens 10 is connected with the light source assembly 20, the positioning columns 14 are sleeved and matched with positioning holes with different sizes in the light source assembly 20, and the positioning holes with different sizes are limited on different limiting surfaces, so that different distances are formed between the lens 10 and the light source assembly 20 in the present embodiment, and the purpose of adjusting the beam angle is achieved; that is, the beam angle of the light source module in the present embodiment is adjustable, and it is convenient to adjust the beam angle.

There may be three lamp bodies 22 and three light guiding grooves 1111, and the three lamp bodies 22 are arranged in one-to-one correspondence with the three light guiding grooves 1111.

In the present embodiment, the number of the positioning holes is the same as the number of the positioning columns 14. Since the number of the positioning columns 14 is at least two, the number of the positioning holes is at least two. In the present embodiment, the number of the groups of positioning holes can also be two, and accordingly, the number of the positioning columns 14 is two. The number of the groups of positioning holes can also be three, and accordingly, the number of the positioning columns 14 is three. The number of the groups of positioning holes can also be four, and accordingly, the number of the positioning columns 14 is four. In order to better position the lens 10 and the light source assembly 20 and to save costs, the number of the positioning holes in the present embodiment is preferably three. There are three groups of positioning holes in FIG. 7, and correspondingly, there are three positioning columns 14.

In the present embodiment, the number of the positioning holes in each group of positioning holes is the same as the number of the limiting surfaces, and the positioning column 14 includes at least three positioning segments, that is, the number of the limiting surfaces is at least two, so the number of the positioning holes in each group of positioning holes is at least two. Alternatively or additionally, the number of the positioning holes in each group of positioning holes in the present embodiment is three. Each group of positioning holes includes a first positioning hole 211', a second positioning hole 211" and a third positioning hole 211'", in sequence, according to an area of the hole from small to large. The first positioning segment 141' and the second positioning segment 141" form a first limiting surface 142' at the interface; the second positioning segment 141" and the third positioning segment 141'" form a second limiting surface 142" at the interface; the third positioning segment 141'" and the fourth positioning segment 141"" form a third limiting surface 142'" at the interface.

Figure 3:
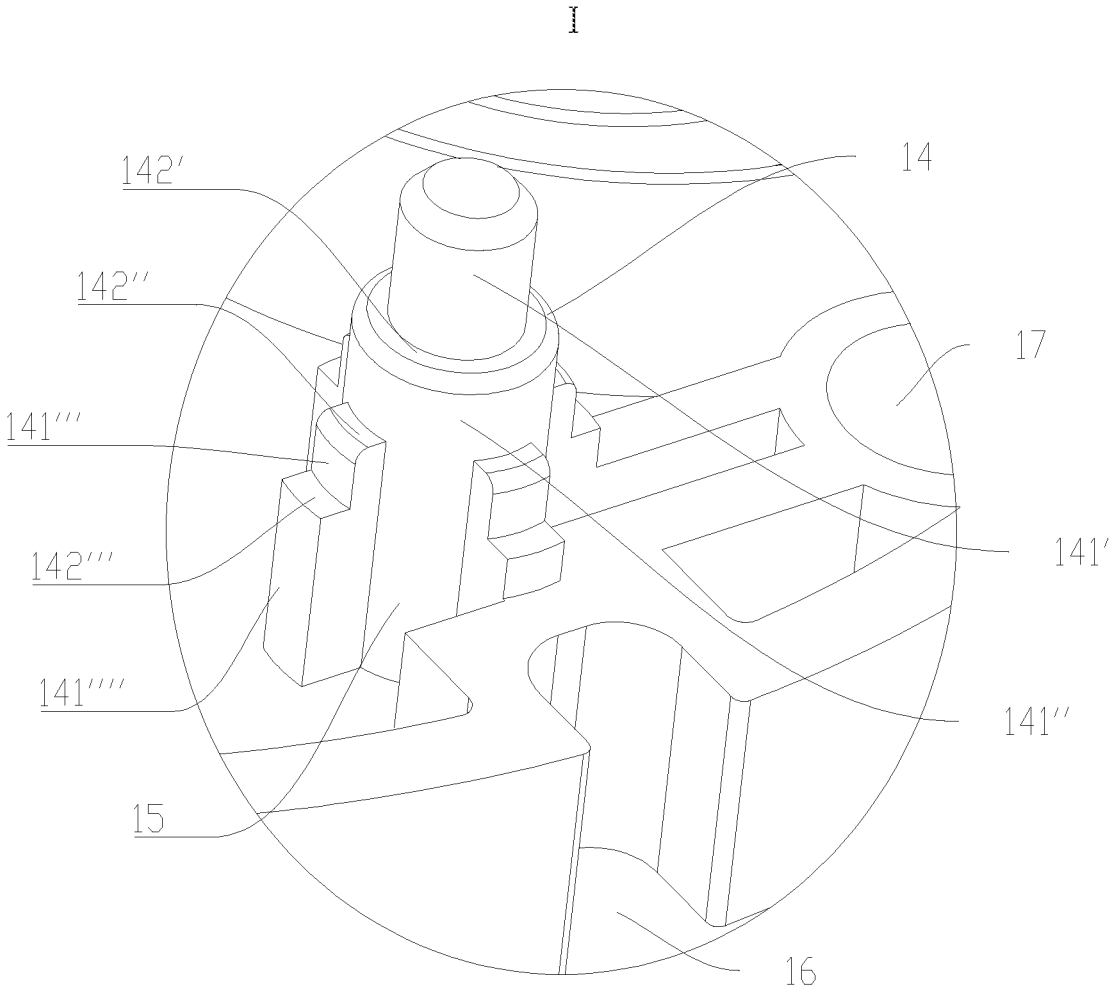
FIG. 3 is a partial enlarged view of FIG. 2 at I.
Figure 4:
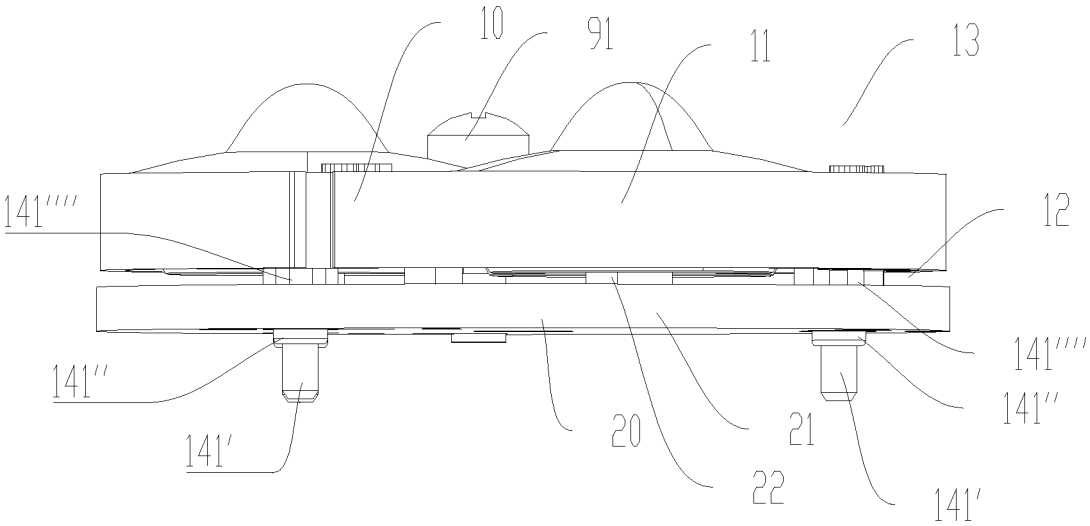
FIG. 4 is a side view of a light source module in one or more examples of the present application under a first beam angle.

With reference to FIG. 3 and FIG. 4, the third positioning holes 211'" of the three groups of positioning holes are all sleeved and matched with the third positioning segment 141'", and are limited by three third limiting surfaces 142'". For example, the beam angle at this time is 36 degrees.

Figure 5:
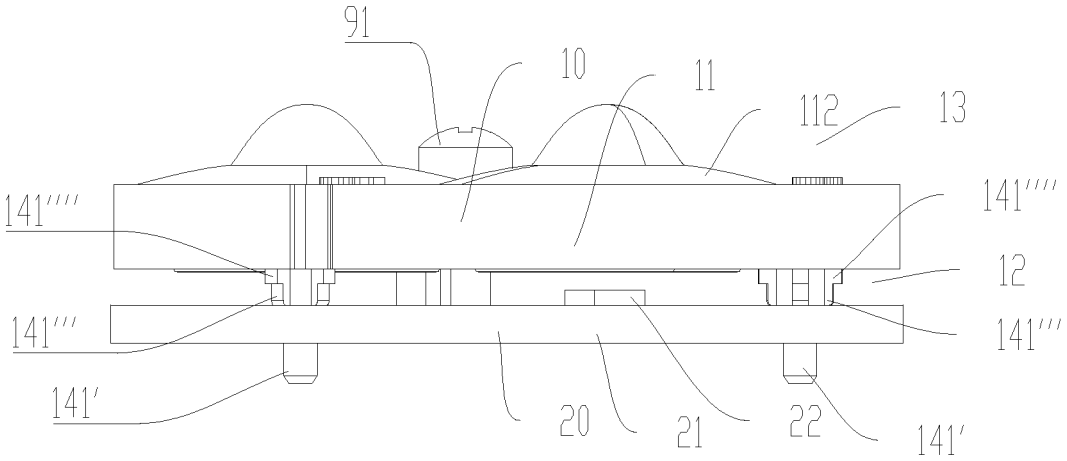
FIG. 5 is a side view of the light source module in one or more examples of the present application under a second beam angle.

With reference to FIG. 3 and FIG. 5, the second positioning holes 211" of the three groups of positioning holes are all sleeved and matched with the second positioning segment 141", and are limited by three second limiting surfaces 142". At this time, the beam angle is decreased, for example, the beam angle is 24 degrees.

With reference to FIG. 3 and FIG. 6, the first positioning holes 211' of the three groups of positioning holes are all sleeved and matched with the first positioning segment 141', and are limited by three first limiting surfaces 142'. At this time, the beam angle is further decreased, for example, the beam angle is 12 degrees.

Alternatively or additionally, the lens body 11 and the light source plate 21 are detachably connected by a connecting piece 91. After the beam angle is adjusted, the lens body 11 and the light source plate 21 are connected together by the connecting piece 91, so that the positions of the lens body 11 and the light source plate 21 are relatively fixed, and the angle of the beam angle is in a fixed state which will not be changed after adjustment.

As shown in FIG. 2, the lens body 11 is provided with a first connecting hole 17, and correspondingly, as shown in FIG. 7, the light source plate 21 is provided with a second connecting hole 212; the first connecting hole 17 and the second connecting hole 212 are arranged to be aligned; the connecting piece 91 can be a bolt; the connecting piece 91 passes through the first connecting hole 17 and the second connecting hole 212 to connect the lens body 11 and the light source plate 21 together.

Since the lens body 11 would rotate relative to the light source plate 21 when the beam angle is adjusted, in order to ensure that the first connecting hole 17 and the second connecting hole 212 can be aligned after each rotation, at least two first connecting holes 17 and at least two second connecting holes 212 are provided. The number of the first connecting holes 17 and the second connecting holes 212 may both be three.

Alternatively or additionally, an edge of the light source plate 21 is provided with a second positioning groove 23. The function of the second positioning groove 23 is to limit and cooperate with the positioning body 34 on the inner wall of the lamp housing 30, thereby fixing the circumferential position of the light source plate 21 and preventing the light source plate 21 from rotating in the mounting cavity 31 of the lamp housing 30.

Figure 8:
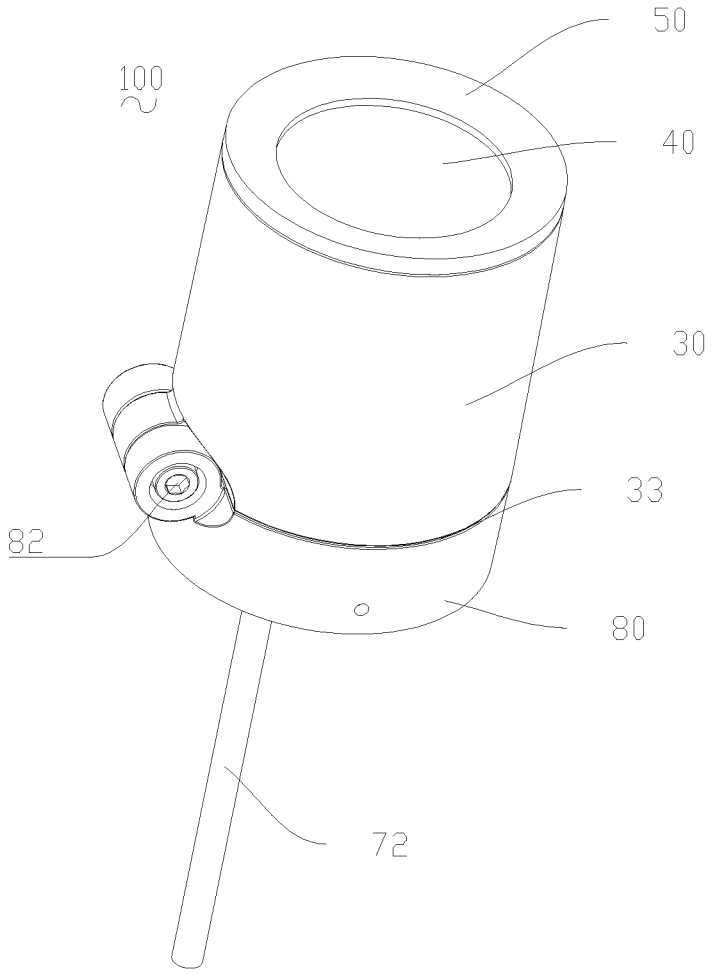
FIG. 8 is a top perspective view of a lighting device according to one or more examples of the present application.
Figure 9:
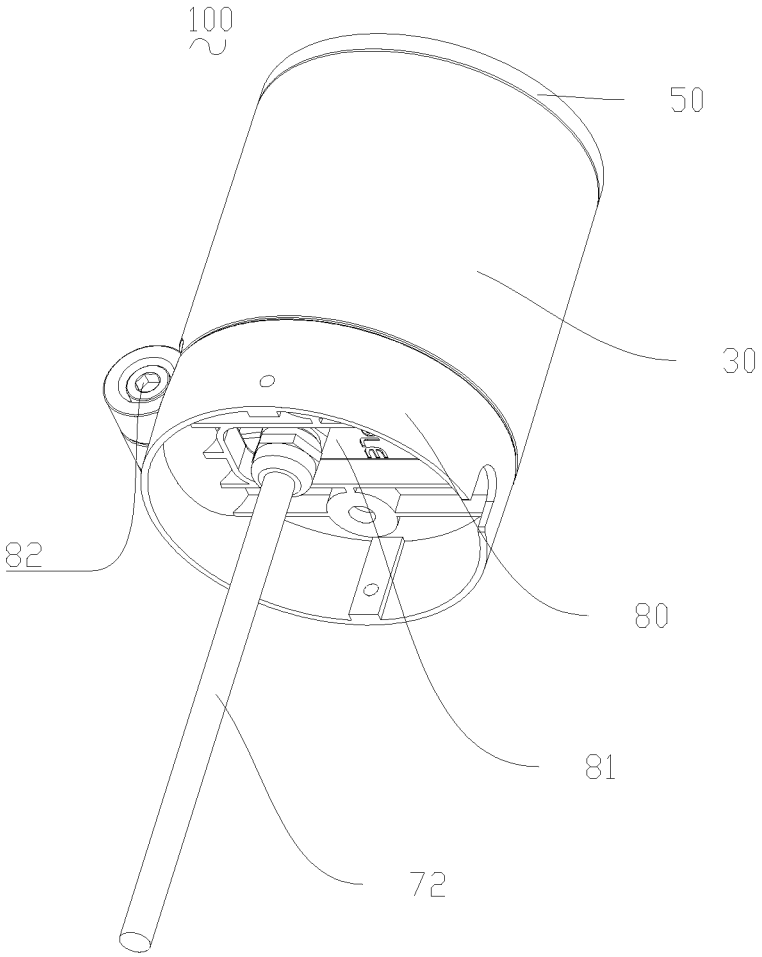
FIG. 9 is a bottom perspective view of the lighting device according to one or more examples of the present application.
Figure 10:
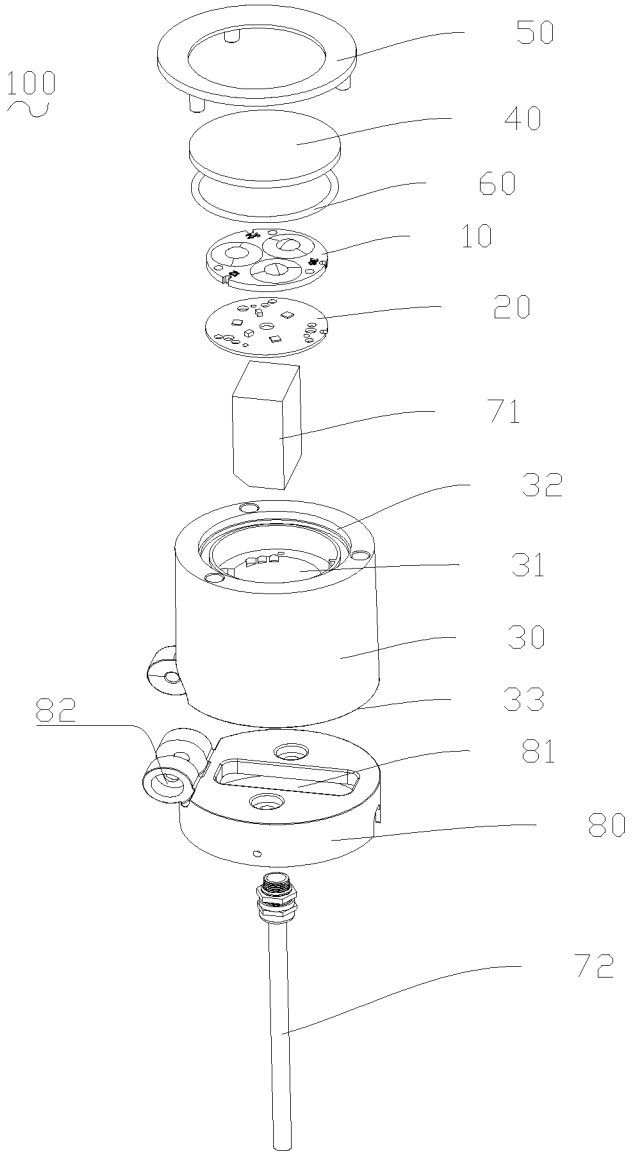
FIG. 10 is an exploded view of the lighting device according to one or more examples of the present application.

As shown in FIG. 8-FIG. 10, the present embodiment discloses a lighting device 100, which includes a lamp housing 30, a power supply assembly and the light source module of one or more examples, and the power supply assembly is electrically connected with the light source assembly 20. The lamp housing 30 has a mounting cavity 31 in which the light source module is mounted. The lamp housing 30 has a light outlet 32, and a distance between the lens 10 and the light outlet 32 is smaller than a distance between the light source assembly 20 and the light outlet 32.

The lighting device 100 of the present embodiment has the advantages that: because at least three positioning segments are sequentially distributed in the first direction and the first areas of the at least three positioning segments are sequentially increased in the first direction, two adjacent positioning segments form a limiting surface at an interface; and because the number of the positioning segments is at least three, at least three positioning segments form at least two limiting surfaces. After the lens 10 is connected with the light source assembly 20, the positioning columns 14 are sleeved and matched with positioning holes with different sizes in the light source assembly 20, and the positioning holes with different sizes are limited on different limiting surfaces, so that different distances are formed between the lens 10 and the light source assembly 20 in the present embodiment, and the purpose of adjusting the beam angle is achieved; that is, the beam angle of the lighting device 100 in the present embodiment is adjustable, and it is convenient to adjust the beam angle.

Alternatively or additionally, the power supply assembly of the present embodiment includes a driving power supply 71, and the driving power supply 71 is arranged in the mounting cavity 31. In the lighting device 100 of the present embodiment, the driving power supply 71 is arranged in the lamp housing 30. Compared with an external power supply, the built-in power supply has better waterproof effect, so that the lighting device 100 of the present embodiment can be applied in outdoor environments.

Figure 12:
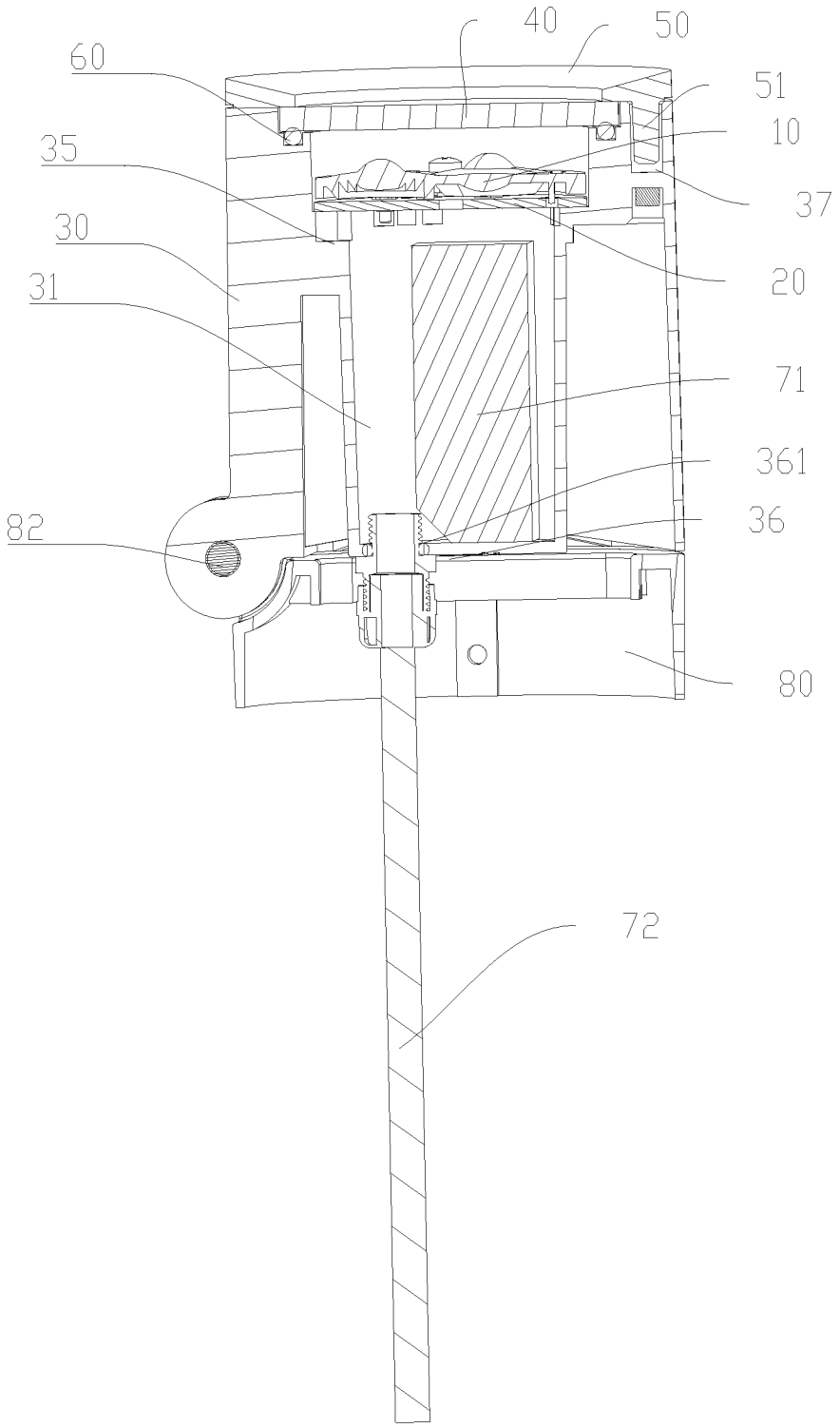
FIG. 12 is a sectional view of the lighting device according to one or more examples of the present application.

Alternatively or additionally, the lighting device 100 of the present embodiment further includes a base 80, and the lamp housing 30 is rotatably connected with the base 80, so that an angle of the lamp housing 30 can be adjusted as required; that is, an irradiation angle of the lighting device 100 can be adjusted. In the lighting device 100 of the present embodiment, not only the angle of the lamp housing 30 is adjustable, but also the beam angle is adjustable. As shown in FIG. 12, the lamp housing 30 is connected with the base 80 through a hinged shaft 82.

Alternatively or additionally, the base 80 is provided with a strip hole 81, and the power supply assembly further includes an electric wire 72, an inner end of the electric wire 72 is electrically connected with the driving power supply 71, an outer end of the electric wire 72 passes through the strip hole 81 to be located outside the base 80, and the electric wire 72 is movably arranged in the strip hole 81. The advantage of arranging the strip hole 81 is that, it is convenient to arrange the electric wire 72 without affecting the adjustment of the angle of the lamp housing 30.

As shown in FIG. 10, an end of the lamp housing 30 opposite to the light outlet 32 is a mounting end 33, and the mounting end 33 is provided with a bottom cover 36 with a through hole 361; the inner end of the electric wire 72 passes through the through hole 361 and enters the mounting cavity 31, the inner end of the electric wire 72 is a waterproof joint, and the inner end of the electric wire 72 is electrically connected with the driving power supply 71. The electric wire 72 is hermetically connected with the through hole 361 to prevent external water vapor from entering the mounting cavity 31. The outer end of the electric wire 72 passes through the strip hole 81 for electrical connection with an external power source.

In order to further improve the waterproof effect of the lighting device 100 100 of the present embodiment, as shown in FIG. 8, it is preferable that a transparent, light-transmitting mask 40 is mounted at the light outlet 32, and the light-transmitting mask 40 is hermetically connected with the lamp housing 30. As shown in FIG. 12, the light-transmitting mask 40 is located on the light emergent side 13 of the lens 10. A sealing ring 60 is arranged between the light-transmitting mask 40 and the lamp housing 30, which further improves the waterproof effect of the lighting device 100. As shown in FIG. 12, the light-transmitting mask 40 is fixed to the lamp housing 30 by a compression ring 50. A connecting post 51 is arranged on a surface of the compression ring 50 opposite to the lamp housing 30, the lamp housing 30 is provided with a third connecting hole 37, and the connecting post 51 is connected with the third connecting hole 37, thereby fixing the light-transmitting mask 40 between the compression ring 50 and the lamp housing 30.

Alternatively or additionally, an edge of the light source plate 21 is provided with a second positioning groove 23, which is communicated with one of the first positioning grooves 16 to constitute a main positioning groove. A positioning body 34 is arranged on the inner wall of the lamp housing 30, and the positioning body 34 is in limited fit with the main positioning groove, so that the lens 10 and the light source plate 21 can be positioned in the circumferential direction, and the lens 10 and the light source plate 21 can be conveniently mounted.

The second positioning groove 23 can be communicated with one of the first positioning grooves 16. In the process of adjusting the beam angle, after separating the lens body 11 from the light source plate 21, rotating the lens body 11 to a required angle and then reconnecting the lens body 11 with the light source plate 21. At this time, the other first positioning groove 16 is communicated with the second positioning groove 23, and the second positioning groove 23 and the other first positioning groove 16 constitute a main positioning groove.

Figure 11:
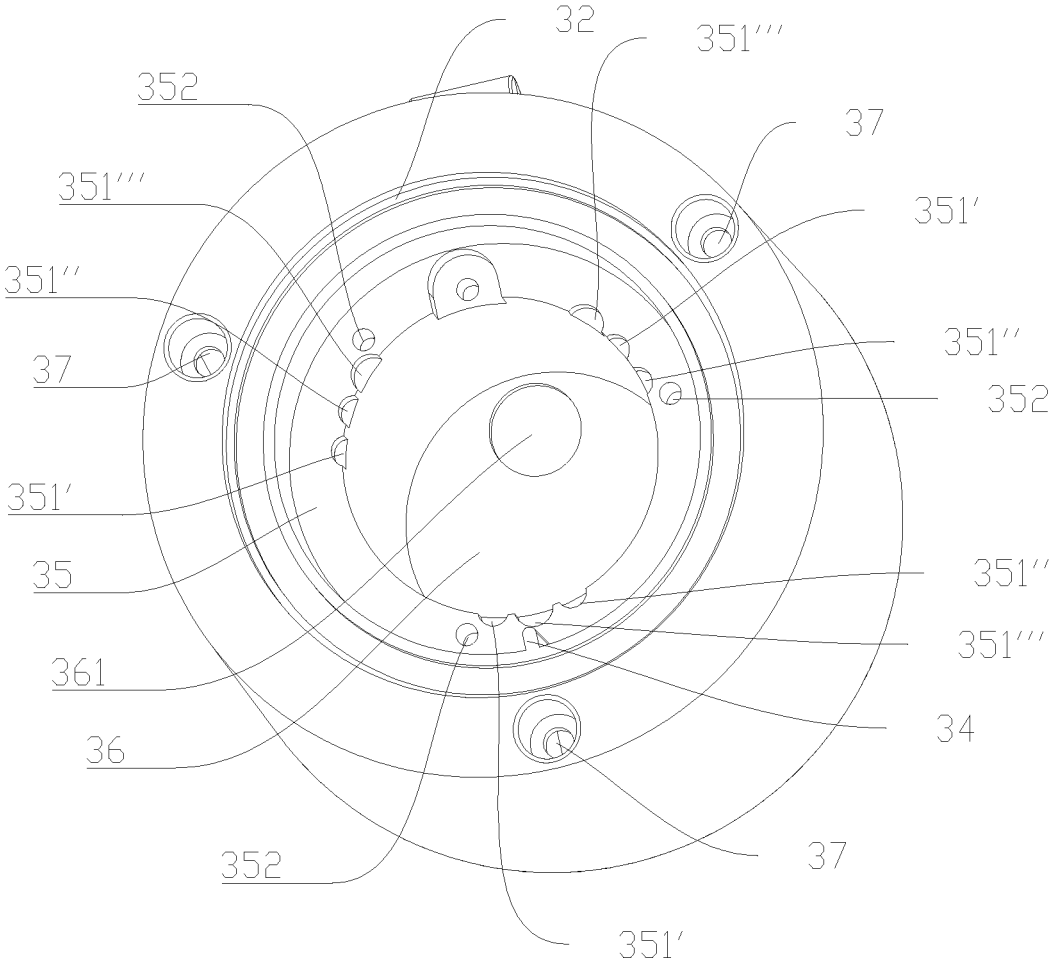
FIG. 11 is a top perspective view of a lamp housing according to one or more examples of the present application.

As shown in FIG. 11, after the lens 10 is connected with the light source plate 21, the positioning column 14 passes through the positioning hole, and the outer end of the positioning column 14 extends out of the positioning hole. After adjusting to different beam angles, the outer end of the positioning column 14 extends beyond the positioning hole by different distances. In order to facilitate the installation of the lens 10 and the light source plate 21, preferably, the inner wall of the lamp housing 30 is provided with a support ring 35, the support ring 35 is in limited fit with the light source plate 21, and the support ring 35 is provided with an avoidance groove, the avoidance groove is opposite to and communicated with the positioning hole and used for allowing the outer end of the positioning column 14 to enter there-through.

As shown in FIG. 12, the support ring 35 has an outer surface for supporting the light source panel 21 and an inner surface, and the driving power supply 71 is arranged between the inner surface of the support ring 35 and the bottom cover 36. A center of the support ring 35 has a through hole, which is used for the driving power supply 71 to pass there-through and enter a space between the inner surface of the support ring 35 and the bottom cover 36. The avoidance groove is provided on the outer surface of the support ring 35.

Since the number of the positioning columns 14 is three, there are three groups of avoidance grooves. As the positioning column 14 has a first positioning segment 141', a second positioning segment 141" and a third positioning segment 141'", correspondingly, the number of the avoidance grooves in each group is three, and the three avoidance grooves are respectively a first avoidance groove 351', a second avoidance groove 351" and a third avoidance groove 351'". The first avoidance groove 351' is used for part of first positioning segments 141' to enter there-through; the second avoidance groove 351" is used for the first positioning segments 141' and part of second positioning segments 141" to enter there-through; and the third avoidance groove 351'" is used for the first positioning segments 141', the second positioning segments 141" and part of third positioning segments 141'" to enter there-through.

After the connecting piece 91 connects the lens body 11 and the light source plate 21, part of the connecting piece 91 extends out of the second connecting hole 212. In order to facilitate the installation of the lens 10 and the light source plate 21, the outer surface of the support ring 35 is provided with an avoidance hole 352 for the end of the connecting piece 91 to enter there-through. The number of the avoidance holes 352 is the same as that of the first connecting holes 17 or the second connecting holes 212.

Alternatively or additionally, in the above lens, the positioning column is a stepped shaft, the positioning segment is a shaft segment, and areas of cross-sectional surfaces of at least three shaft segments are sequentially increased in the first direction.

Alternatively or additionally, in the above lens, a peripheral surface of the stepped shaft is provided with at least one groove.

Alternatively or additionally, in the above lens, the light incident surface is provided with a light guiding groove, and the light guiding groove is recessed towards the light exiting surface.

Alternatively or additionally, in the above lens, an external rim of the lens body is provided with at least two first positioning grooves which are distributed at intervals, and the number of the first positioning grooves is one less than the number of the shaft segments.

Alternatively or additionally, in the above lens, the light exiting surface is provided with at least two angle scales, and the at least two angle scales are arranged in one-to-one correspondence with the at least two first positioning grooves.

Alternatively or additionally, in the above light source module, the lens body and the light source plate are detachably connected through a connecting piece.

Alternatively or additionally, in the above light source module, an edge of the light source plate is provided with a second positioning groove.

Alternatively or additionally, in the above lighting device, the power supply assembly includes a driving power supply, and the driving power supply is arranged in the mounting cavity.

Alternatively or additionally, the above lighting device further includes a base, and the lamp housing is rotatably connected with the base.

Alternatively or additionally, in the above lighting device, the light outlet is provided with a transparent light-transmitting mask, and the diffuser is hermetically connected with the lamp housing.

Alternatively or additionally, in the above lighting device, the edge of the light source plate is provided with a second positioning groove, the second positioning groove is communicated with one of the first positioning grooves to constitute a main positioning groove; an inner wall of the lamp housing is provided with a positioning body which is in limited fit with the main positioning groove.

Alternatively or additionally, in the above lighting device, a support ring is arranged on the inner wall of the lamp housing, the support ring is in limited fit with the light source plate, an avoidance groove is arranged on the support ring, and the yielding groove is arranged opposite to and communicated with the positioning hole.

The present application has the advantages that: because at least three positioning segments are sequentially distributed in the first direction and the first areas of the at least three positioning segments are sequentially increased in the first direction, two adjacent positioning segments form a limiting surface at an interface there-between; and because the number of the positioning segments is at least three, the at least three positioning segments form at least two limiting surfaces. After the lens of the present application is connected with the light source assembly, the positioning columns are sleeved and matched with the positioning holes with different sizes in the light source assembly, and the positioning holes with different sizes are limited on different limiting surfaces, so that different distances are formed between the lens and the light source assembly, thereby achieving the purpose of adjusting the beam angle and facilitating the adjustment of the beam angle.

The above embodiments of the present application focus on the differences among the various embodiments, and the different optimized features among the various embodiments can be combined to form better embodiment(s) as long as they are not contradictory. Considering the brevity of the text, they will not be repeated here.

The above are merely embodiments of the present application, and are not intended to limit the present application in any way. For those skilled in the art, the present application can be modified and varied. Any modification, equivalent substitution, improvement, etc. made within the spirit and principle of the present application shall be included within the scope of the claims of the present application.

What is claimed is:

1. A lens, comprising:

a lens body and a positioning column, wherein the lens body has a light incident surface and a light exiting surface, an inner end of the positioning column is connected to the light incident surface, an outer end of the positioning column is a free end, and a direction from the outer end to the inner end of the positioning column is a first direction;

the positioning column comprises at least three positioning segments sequentially distributed in the first direction, and the positioning column is a stepped shaft with shaft segments, wherein one of the at least three positioning segments is a shaft segment;

an external rim of the lens body is provided with at least two first positioning grooves distributed at intervals, and the number of the first positioning grooves is one less than the number of the shaft segments.

2. The lens according to claim 1, wherein a periphery surface of the stepped shaft is provided with at least one groove.

3. The lens according to claim 1, wherein the light incident surface is provided with a light guiding groove, and the light guiding groove is recessed towards the light exiting surface.

4. The lens according to claim 1, wherein the light exiting surface is provided with at least two angle scales, and the at least two angle scales are arranged in one-to-one correspondence with the at least two first positioning grooves.

5. A light source module, comprising:

a light source assembly and a lens comprising a lens body and a positioning column, wherein the lens body has a light incident surface and a light exiting surface, an inner end of the positioning column is connected to the light incident surface, an outer end of the positioning column is a free end, and a direction from the outer end to the inner end of the positioning column is a first direction;

the positioning column comprises at least three positioning segments sequentially distributed in the first direction, and the positioning column is a stepped shaft with shaft segments, wherein one of the at least three positioning segments is a shaft segment;

an external rim of the lens body is provided with at least two first positioning grooves distributed at intervals, and the number of the first positioning grooves is one less than the number of the shaft segments, wherein the light source assembly comprises a light source plate and a lamp body arranged on the light source plate, and at least two groups of positioning holes are further arranged on the light source plate; each group of positioning holes comprises at least two positioning holes, and areas of the at least two positioning holes in each group of positioning holes are different.

6. The light source module according to claim 5, wherein the lens body and the light source plate are detachably connected by a connecting piece.

7. The light source module according to claim 5, wherein an edge of the light source plate is provided with a second positioning groove.

8. A lighting device, comprising a lamp housing, a power supply assembly and a light source module comprising: a light source assembly and a lens comprising a lens body and a positioning column, wherein the lens body has a light incident surface and a light exiting surface, an inner end of the positioning column is connected to the light incident surface, an outer end of the positioning column is a free end, and a direction from the outer end to the inner end of the positioning column is a first direction;

the positioning column comprises at least three positioning segments sequentially distributed in the first direction, and the positioning column is a stepped shaft with shaft segments, wherein one of the at least three positioning segments is a shaft segment;

an external rim of the lens body is provided with at least two first positioning grooves distributed at intervals, and the number of the first positioning grooves is one less than the number of the shaft segments wherein the light source assembly comprises a light source plate and a lamp body arranged on the light source plate, and at least two groups of positioning holes are further arranged on the light source plate; each group of positioning holes comprises at least two positioning holes, and areas of the at least two positioning holes in each group of positioning holes are different, wherein the power supply assembly is electrically connected with the light source assembly; the lamp housing is provided with a mounting cavity, and the light source module is mounted in the mounting cavity; the lamp housing is provided with a light outlet, and a distance between the lens and the light outlet is smaller than a distance between the light source assembly and the light outlet.

9. The lighting device according to claim 8, wherein the power supply assembly comprises a driving power supply, and the driving power supply is arranged in the mounting cavity.

10. The lighting device according to claim 8, wherein the lighting device further comprises a base, and the lamp housing is rotatably connected with the base.

11. The lighting device according to claim 8, wherein the light outlet is provided with a transparent, light-transmitting mask and the light-transmitting mask is hermetically connected with the lamp housing.

12. The lighting device according to claim 8, wherein an edge of the light source plate is provided with a second positioning groove.

13. The lighting device according to claim 8, wherein a support ring is arranged on the inner wall of the lamp housing.

* * * * *